US010836530B2

(12) United States Patent
Palmer

(10) Patent No.: US 10,836,530 B2
(45) Date of Patent: Nov. 17, 2020

(54) CONTAINER WITH CRUSH RESISTANT SPOUT AND METHOD OF MANUFACTURING THE SAME

(71) Applicant: Consolidated Container Company LP, Atlanta, GA (US)

(72) Inventor: Joey Palmer, Marietta, GA (US)

(73) Assignee: Altium Packaging LP, Atlanta, GA (US)

( * ) Notice: Subject to any disclaimer, the term of this patent is extended or adjusted under 35 U.S.C. 154(b) by 157 days.

(21) Appl. No.: 15/923,186

(22) Filed: Mar. 16, 2018

(65) Prior Publication Data

US 2018/0265240 A1 Sep. 20, 2018

Related U.S. Application Data

(60) Provisional application No. 62/472,974, filed on Mar. 17, 2017.

(51) Int. Cl.
*B65D 1/02* (2006.01)
*B65D 1/42* (2006.01)

(52) U.S. Cl.
CPC ..... *B65D 1/023* (2013.01); *B65D 1/42* (2013.01); *B65D 2501/0081* (2013.01)

(58) Field of Classification Search
CPC ..... B65D 1/0246; B65D 1/42; B65D 1/023
See application file for complete search history.

(56) References Cited

U.S. PATENT DOCUMENTS

D195,697 S 7/1963 Price et al.
D197,190 S 12/1963 Natale et al.
D201,051 S 5/1965 Shepler et al.
D201,103 S 5/1965 Caisse et al.
D203,560 S 1/1966 Erickson et al.
D204,701 S 5/1966 Shepler et al.
(Continued)

FOREIGN PATENT DOCUMENTS

WO WO 1998/033712 A1 8/1998

OTHER PUBLICATIONS

International Searching Authority, International Search Report and Written Opinion for International Application No. PCT/US2018/022808, dated May 15, 2018, 14 pages, U.S.A.
(Continued)

*Primary Examiner* — Jeffrey R Allen
(74) *Attorney, Agent, or Firm* — Alston & Bird LLP

(57) ABSTRACT

Various embodiments are directed to a container spout secured relative to a hollow container body. The container spout includes a cap region configured to accept a container cap (e.g., a snap-on cap), and a support region positioned between the cap region and the hollow container body. The support region comprises one or more bumper rolls positioned around an exterior of the support region and one or more support protrusions extending between a bottom edge of the cap region and a bottom edge of the support region, wherein each of the one or more support protrusions defines a substantially horizontal convex curvature having a radius smaller than a radius of the container spout. The support protrusions are aligned with corners of the container, and thereby transfer axial crushing forces applied to the container spout onto the container corners to increase the axial crush resistance of the container.

23 Claims, 8 Drawing Sheets

(56) References Cited

U.S. PATENT DOCUMENTS

| | | | | |
|---|---|---|---|---|
| D208,824 | S | 10/1967 | Platte et al. | |
| D215,410 | S | 9/1969 | Hills et al. | |
| D229,296 | S | 11/1973 | Cutler et al. | |
| D238,654 | S | 2/1976 | Platte et al. | |
| D250,995 | S | 2/1979 | Beaver | |
| 4,372,455 | A | 2/1983 | Cochran | |
| D309,421 | S | 7/1990 | Aldrich, III | |
| 4,964,522 | A | 10/1990 | Umetsu et al. | |
| D348,612 | S | 7/1994 | Ring | |
| D379,929 | S | 6/1997 | Dallaire | |
| D391,854 | S | 3/1998 | Ankney et al. | |
| 5,833,115 | A * | 11/1998 | Eiten | B65D 1/0223 220/669 |
| 6,068,161 | A | 5/2000 | Soehnlen et al. | |
| D427,076 | S | 6/2000 | Ankney et al. | |
| 6,237,792 | B1 | 5/2001 | Skolnicki et al. | |
| D470,417 | S | 2/2003 | Anderson | |
| 6,527,133 | B1 | 3/2003 | McCollum et al. | |
| 6,588,612 | B1 | 7/2003 | Dorn et al. | |
| D485,497 | S | 1/2004 | Steele, IV et al. | |
| D488,721 | S | 4/2004 | Peronek | |
| 6,889,858 | B2 | 5/2005 | McCollum et al. | |
| 7,059,486 | B2 | 6/2006 | Van Der Heijden | |
| D593,863 | S | 6/2009 | Fahy et al. | |
| 7,699,171 | B2 | 4/2010 | Rivera et al. | |
| 8,047,392 | B2 | 11/2011 | Eiten et al. | |
| D662,421 | S | 6/2012 | Dorn | |
| D678,072 | S | 3/2013 | Lobbestael et al. | |
| 8,535,599 | B1 | 9/2013 | Lobbestael et al. | |
| 8,668,101 | B2 | 3/2014 | Lobbestael et al. | |
| 8,893,908 | B2 | 11/2014 | Treece et al. | |
| 8,979,524 | B2 | 3/2015 | Lobbestael et al. | |
| D733,566 | S | 7/2015 | Lobbestael et al. | |
| D739,248 | S | 9/2015 | Janeczek | |
| D742,747 | S | 11/2015 | Lobbestael et al. | |
| 9,446,551 | B2 | 9/2016 | Lobbestael et al. | |
| D800,567 | S | 10/2017 | Palmer et al. | |
| 9,981,768 | B1 | 5/2018 | Palmer | |
| D823,690 | S | 7/2018 | Palmer et al. | |
| D823,691 | S | 7/2018 | Palmer et al. | |
| 10,384,824 | B2 | 8/2019 | Palmer et al. | |
| 2003/0006210 | A1 | 1/2003 | Iizuka et al. | |
| 2003/0155324 | A1 | 8/2003 | McCollum et al. | |
| 2003/0230545 | A1 | 12/2003 | Mount et al. | |
| 2004/0094502 | A1 | 5/2004 | Boukobza | |
| 2005/0082251 | A1 | 4/2005 | Darr et al. | |
| 2006/0260971 | A1 | 11/2006 | Rivera et al. | |
| 2007/0023384 | A1 | 2/2007 | Janeczek | |
| 2010/0089863 | A1 | 4/2010 | Matsuoka | |
| 2011/0132863 | A1 | 6/2011 | Dorn | |
| 2012/0241405 | A1 | 9/2012 | Lobbestael et al. | |
| 2013/0001234 | A1 | 1/2013 | Glover | |
| 2013/0243896 | A1 | 9/2013 | Lobbestael et al. | |
| 2016/0272356 | A1* | 9/2016 | Simpson | B65D 25/2885 |
| 2018/0244423 | A1 | 8/2018 | Palmer et al. | |
| 2019/0193890 | A1 | 6/2019 | Palmer et al. | |

OTHER PUBLICATIONS

U.S. Patent and Trademark Office, Notice of Allowance for U.S. Appl. No. 29/645,266, dated Oct. 2, 2019, (16 pages), USA.

Australian Examination Report for Australian Patent Application No. 2018234841, dated Apr. 20, 2020, (3 pages), IP Australia, Canberra, Australia.

* cited by examiner

CONTAINER WITH CRUSH RESISTANT SPOUT AND METHOD OF MANUFACTURING THE SAME

CROSS-REFERENCE TO RELATED APPLICATIONS

This patent application claims priority from U.S. Provisional Appl. Ser. No. 62/472,974, filed Mar. 17, 2017, which is incorporated herein by reference in its entirety.

BACKGROUND

Containers that may be used to enclose and transport fluids are often subject to significant stresses during use. Such containers may be dropped while full or partially full of fluid, stacked on top of one another, supported in a suspended configuration (e.g., when held by a user), and/or the like. Accordingly, various containers incorporate various strengthening features in order to provide strength to the container against breakage.

However, various containers may be subject to additional limitations, such as a requirement to minimize the cost of materials in the containers, the weight of materials in the containers, and/or the like. Accordingly, container configurations often are subject to generally conflicting design considerations of maximizing the strength of the container while minimizing the cost and/or weight of materials in the container.

Accordingly, a need exists for containers providing an optimal balance of maximum strength against undesired breakage while minimizing the cost and/or weight of materials in the container.

BRIEF SUMMARY

Various embodiments are directed to container spout constructions having increased crush resistance. The spout constructions define a support region extending around a base of the spout, the support region comprising a plurality of support protrusions and/or support indentions spaced at least substantially equally about the perimeter of the support portion and/or the support protrusions and/or support indentions may be aligned with corners of the container. The support protrusions and/or support indentions may have a radius of curvature smaller than the radius of the spout, thereby forming curved corner regions within the support region of the spout. The support protrusions and/or support indentions thereby transfer crushing forces into the corners of the container, thereby impeding crushing of the spout and/or the container when the container is subject to an axial crushing force, for example, when a snap-on cap is applied to the spout.

Certain embodiments are directed to a container comprising: a hollow body portion; and a circular spout forming an opening in the hollow body portion. In certain embodiments the spout comprises: a cap region configured to accept a container cap secured thereto; and a support region positioned between the hollow body portion and the cap region, wherein the support region comprises: one or more bumper rolls positioned around an exterior of the support region; and one or more support protrusions extending between a bottom edge of the cap region and a bottom edge of the support region, wherein each of the one or more support protrusions defines a substantially horizontal convex curvature having a radius of curvature smaller than a radius of the spout.

In certain embodiments, the hollow body portion defines one or more vertical corners between adjacent sidewalls; and the one or more support protrusions are aligned with a respective vertical corner of the hollow body portion. Moreover, the hollow body portion may define alternating long sidewalls and short sidewalls, wherein adjacent sidewalls are separated by vertical corners; and the one or more support protrusions may be aligned with a respective short sidewall of the hollow body portion. In certain embodiments, the support region comprises a plurality of bumper rolls positioned around the exterior of the support region; and a plurality of support protrusions positioned around the exterior of the support region and aligned with the plurality of bumper rolls, wherein the plurality of support protrusions are positioned between adjacent bumper rolls such that the bumper rolls and the support protrusions are alternating around the perimeter of the spout. The adjacent support protrusions according to certain embodiments blend together to form a support portion below an included bumper roll; and wherein the adjacent support protrusions and the support portion are spaced a minimum distance away from the included bumper roll. In certain embodiments, the plurality of bumper rolls includes 4 bumper rolls spaced at 90 degree intervals around the perimeter of the spout; and the plurality of support protrusions includes 4 support protrusions spaced at 90 degree intervals around the perimeter of the spout, and wherein the plurality of support protrusions are offset by 45 degrees relative to the plurality of bumper rolls. In certain embodiments, the support portion extends at least substantially continuously around the perimeter of the spout. Moreover, the spout may further comprise a step positioned between the support region and the hollow body portion. The cap region may be configured to accept a snap-on cap secured thereto. Moreover, the cap region may comprise a plurality of ridges adjacent a bottom edge of the cap region.

In certain embodiments, each of the one or more support protrusions defines a complex curvature having a substantially vertical concave curvature. Moreover, each of the one or more support protrusions may define a complex curvature having a substantially vertical convex curvature.

Certain embodiments are directed to a circular container spout secured relative to a hollow container body. The circular container spout may comprise: a cap region configured to accept a container cap secured thereto; a support region positioned between the cap region and the hollow container body, wherein the support region comprises: one or more bumper rolls positioned around an exterior of the support region; and one or more support protrusions extending between a bottom edge of the cap region and a bottom edge of the support region, wherein each of the one or more support protrusions defines a substantially horizontal convex curvature having a radius of curvature smaller than a radius of the container spout.

In certain embodiments, the support region comprises: a plurality of bumper rolls positioned around the exterior of the support region; and a plurality of support protrusions positioned around the exterior of the support region and aligned with the plurality of bumper rolls, wherein the plurality of support protrusions are positioned between adjacent bumper rolls such that the bumper rolls and the support protrusions are alternating around the perimeter of the spout. Moreover, adjacent support protrusions may blend together to form a support portion below an included bumper roll; and wherein the adjacent support protrusions and the support portion are spaced a minimum distance away from the included bumper roll. In certain embodiments, the plurality of bumper rolls includes 4 bumper rolls spaced at 90 degree intervals around the perimeter of the spout; and the plurality of support protrusions includes 4 support protrusions spaced at 90 degree intervals around the perimeter of the spout, and wherein the plurality of support protrusions are offset by 45 degrees relative to the plurality of bumper rolls. According to certain embodiments, the support portion extends at least substantially continuously around the perimeter of the spout. The spout of certain embodiments further comprises: a step positioned between the support region and the hollow body portion.

The cap region of certain embodiments may be configured to accept a snap-on cap or a screw-on cap secured thereto. Moreover, the cap region may comprise a plurality of ridges adjacent a bottom edge of the cap region. In certain embodiments, each of the one or more support protrusions defines a complex curvature having a substantially vertical concave curvature. Moreover, each of the one or more support protrusions may define a complex curvature having a substantially vertical convex curvature.

Certain embodiments are directed to a container spout secured relative to a hollow container body comprising: a cap region configured to accept a container cap secured thereto; a support region positioned between the cap region and the hollow container body, wherein the support region comprises: one or more bumper rolls positioned around an exterior of the support region; and one or more support indentions extending between a bottom edge of the cap region and a bottom edge of the support region, wherein each of the one or more support protrusions defines at least one substantially horizontal concave curvature having a radius of curvature smaller than a radius of the container spout. The container spout may form a portion of a container comprising a hollow body portion.

Certain embodiments are directed to a circular container spout secured relative to a hollow container body comprising: a cap region configured to accept a container cap secured thereto; a support region positioned between the cap region and the hollow container body, wherein the support region comprises: one or more bumper rolls positioned around an exterior of the support region; and an indent ring positioned between the one or more bumper rolls and the cap region, wherein the indent ring comprises one or more support protrusions spaced around the perimeter of the spout. Moreover, the container spout may form a portion of a container comprising a hollow body portion.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

Figure 1:
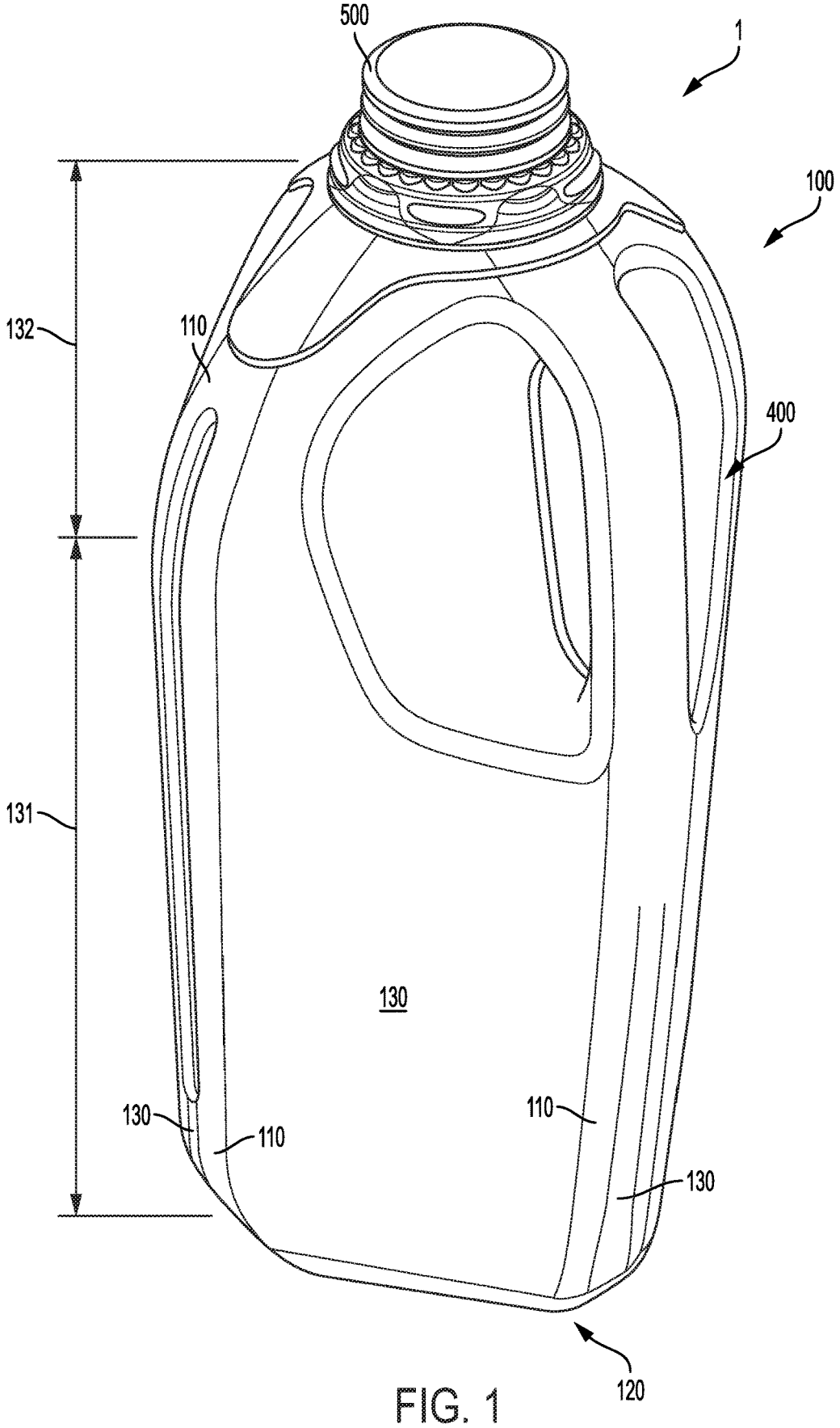
FIG. 1 shows an isometric view of a container according to one embodiment.

The present invention will now be described more fully hereinafter with reference to the accompanying drawings, in which some, but not all embodiments of the invention are shown. Indeed, the invention may be embodied in many different forms and should not be construed as limited to the embodiments set forth herein. Rather, these embodiments are provided so that this disclosure will satisfy applicable legal requirements. Like numbers refer to like elements throughout.

Overview

Described herein is a container configured to enclose a fluid and/or other substance. In various embodiments, the container may comprise a plastic material (e.g., High-Density Polyethylene (HDPE)). As a non-limiting example, the container may comprise at least about 52-72 g of material to provide a container having an interior volume of at least substantially 1 gallon; substantially larger or smaller containers may be formed or provided, with structural features beyond size/dimension otherwise as detailed herein. The body of the container may define one or more strengthening features that provide desirable strength characteristics for the container. For example, various strengthening features may comprise one or more ribs, grooves, raised features, and/or the like, that may extend across planar surfaces, curved surfaces, and/or complex curved surfaces in order to provide crush resistance, tensile strength, and/or the like for the container.

The container comprises a circular spout defining an opening into the interior of the container. The spout is located at a top, central portion of the container, generally centered relative to the body of the container. The spout defines a cap connecting region at an open end of the spout, the cap connecting region configured to be detachably secured relative to a cap (e.g., a snap-on cap, a screw-on cap, and/or the like). Between the cap connecting region and the upper portion of the body of the container, the spout defines a support region extending around the perimeter of the spout, the support region comprising one or more support protrusions extending between the base of the cap connecting region and the base of the spout. The support protrusions are spaced around the perimeter of the spout, and each comprise convex portions extending away from the spout and defining rounded corners around the perimeter of the support region such that the support region is defined by a non-circular cross section. The support protrusions may be aligned with corners and/or short sidewalls of the container, such that crushing forces aligned with the central axis of the spout and container are directed along the support protrusions to the corners and/or short sidewalls of the container. The support protrusions may thus be positioned to direct axial crushing forces aligned with the central axis of the spout and container to features of the container providing high crush resistance (e.g., corners of the container).

The support region may additionally comprise one or more bumper rolls—protrusions having defined top portions and bottom portions—configured to enable a gripping mechanism (e.g., a robotized gripper) to securely hold the container suspended by the bumper rolls. In certain embodiments, the bumper rolls and the support protrusions may be in an alternating arrangement around the perimeter of the spout. As just one non-limiting example, the spout may define 4 support protrusions spaced evenly around the perimeter of the spout and 4 bumper rolls spaced evenly around the perimeter of the spout, offset by 45 degrees relative to the positioning of the support protrusions.

The support region thereby provides increased crush resistance to the spout, particularly when subject to axial crushing forces, which may be caused by pressing a snap-on cap onto the cap region of the spout.

Container Construction

In various embodiments, the container 1 may comprise an at least semi-rigid material. Semi-rigid containers 1 may be configured to flex when exposed to externally applied forces, and/or rigid containers 1 may be configured to resist substantial flexing when subject to externally applied forces. For example, the container 1 may comprise plastic, metal, and/or the like. As just one specific example, the container 1 may comprise HDPE. As will be discussed herein, the container may be extrusion blow-molded. In such embodiments, the container 1 may comprise at least approximately 52-72 g of material to provide a 1-gallon interior volume container. As other example embodiments, the container 1 may comprise at least approximately 32-38 g of material for a ½-gallon interior volume container, and/or at least approximately 23-29 g of material for a 1-quart interior volume container. However, it should be understood that higher or lower amounts of material may be provided to form containers having similar or different internal volumes to those described above.

The container 1 defines a container body 100 that may have a configuration similar to that described in co-pending U.S. patent application Ser. No. 15/255,403, filed on Sep. 2, 2016 and incorporated herein by reference in its entirety. In various embodiments, the container 1 may comprise a base portion 120 (e.g., a base surface) configured for resting on a support surface and a plurality of sidewalls 130 extending away from the base portion toward the spout. The sidewalls may comprise a vertical portion 131 adjacent to and extending away from the base portion and a top converging portion 132 extending between the vertical portion and the spout. In various embodiments, the vertical portion 131 extends away from the base portion in a direction at least substantially perpendicular to a surface of the portion (e.g., the base surface 120). The top converging portion 132 may be separated from the vertical portion by a top transition region (e.g., a curved portion) in which the side walls curve from the generally vertical portions to the angled and planar top converging portion that extends upward and toward the center of the container 1 toward the spout.

In various embodiments, the container 1 may have four sidewalls 130 separated by corners 110 between adjacent sidewalls 130, such that the container 1 has an at least substantially rectangular (e.g., square) cross-section. As yet another example, the container 1 may have four long sidewalls 130 separated by four short sidewalls 130, with corners 110 between adjacent long and short sidewalls, such that the container 1 has an at least substantially octagonal cross-section. It should be understood that the container 1 may have any number of sidewalls 130, and accordingly the container 1 may have any of a variety of cross-sectional shapes (e.g., 3 sidewalls, forming an at least substantially triangular shape; 6 sidewalls, forming an at least substantially hexagonal shape; and/or the like).

In various embodiments, the corners 110 may extend between the base portion 120 and the spout 500. Moreover, in embodiments in which the sidewalls 130 comprise a plurality of long sidewalls and short sidewalls, the short sidewalls may converge at a base portion of the spout 500 to form substantially continuous corners 110 between adjacent long sidewalls 130.

Except as otherwise discussed herein, the container 1 may have an at least substantially uniform wall thickness (measured between the interior of the container 1 and the exterior surface of the container 1). For example, the container 1 may have a wall thickness of at least approximately 0.007-0.011 inches (e.g., 0.009 inches). Accordingly, each sidewall 130 may have an at least substantially uniform wall thickness between the vertical portion 131, top transition region, and converging portion 132. In various embodiments, the container 1 may be configured to resist a vertical crushing force of at least approximately 30 lbf of force with about a ¼" deflection in overall height of the container when filled and having a cap secured onto a spout 500 thereof before breaking. Moreover, the container 1 may be configured to fall from a height of at least approximately 2 feet onto a hard surface without breaking.

In various embodiments, the container 1 may comprise a handle portion 400 formed as a portion of the one or more sidewalls 130. For example, the handle portion 400 may occupy a portion of the container 1 corresponding to two long sidewalls and one short sidewall (in an embodiment comprising a plurality of alternating short and long sidewalls). As yet another example, the handle portion may occupy a portion of the container 1 corresponding to two sidewalls 130 and an included corner 110 between the two sidewalls 130. The center of the handle 400 may be aligned at least substantially with a corner 110 of the container and/or a short sidewall of the container 1. The handle 400 may be positioned to encompass a portion of the vertical section 131 of the sidewalls 130 and a portion of the top converging portion 132 of the sidewalls 130. In various embodiments, a top edge of the handle portion 400 may be aligned with and/or adjacent to a bottom portion of the spout 500.

In various embodiments, the handle portion 400 may comprise a handle cavity and a handle extending between a bottom edge of the handle portion 400 and the top edge of the handle portion 400. The handle may be spaced apart from an included surface of the handle portion 400 defined by the handle cavity, such that a portion of a user's hand may fit between the handle and the included surface of the handle cavity.

Spout

Figure 2:
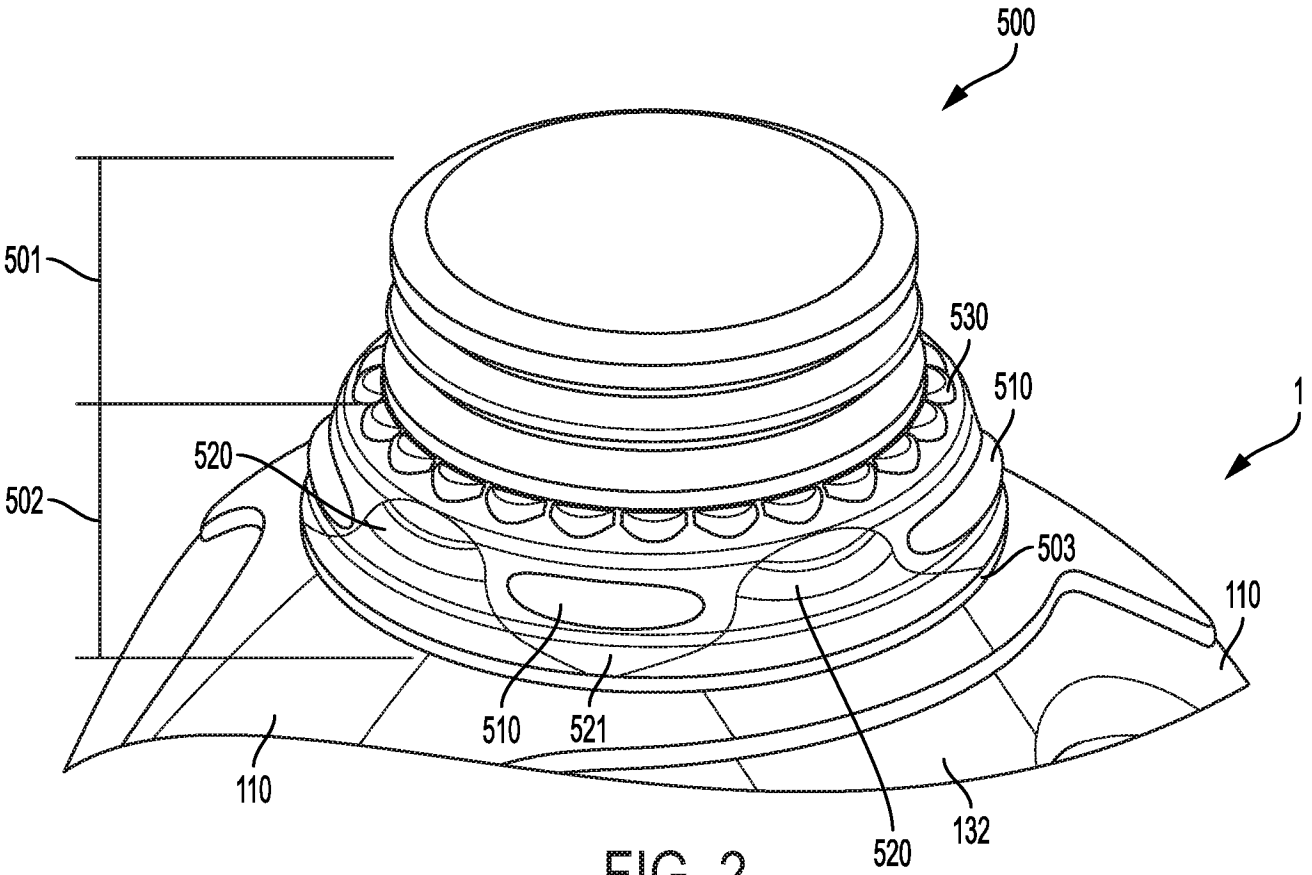
FIG. 2 shows a close-up side view of a spout according to one embodiment.

As shown in FIG. 2, the spout 500 extends above the top converging portion 132, and forms an opening from which the contents of the container 1 may be added to the container and/or removed from the container 1. The spout 500 may define a raised step 503 surrounding the spout 500 and intersecting the top converging portion 132. The raised step 503 may extend between the top converging portion 132 and a support region 502 extending at least substantially vertically from the step 503. The support region 502 may define a plurality of protrusions 510, 520 thereon and spaced around the perimeter of the support region 502. The support region 502 may extend upward to a cap engagement portion 501 defining one or more threads, nipples, and/or the like to engage a removable cap (not shown) such that the removable cap may be selectably secured to the container 1. The cap engagement portion 501 may comprise a plurality of ridges 530 configured to provide additional crushing resistance, by providing a plurality of at least substantially vertical portions (e.g., the edges of the ridges 530) proximate a bottom portion of the cap engagement portion 501.

In various embodiments, one or more portions of the spout 500 may have a wall thickness greater than the wall thickness of remaining portions of the container 1. Particularly in embodiments comprising a threaded cap engagement portion 501, the cap engagement portion 501 may not be symmetrical across a central plane of the container 1.

The support region 502 comprises a plurality of bumper rolls 510 spaced around the perimeter of the spout 500. In various embodiments, the bumper rolls 510 may be aligned with a centerline of a long sidewall 130 of the container 1.

The bumper rolls 510 may reside within a single elevation on the external surface of the spout 500, and the bumper rolls 510 may have an at least substantially identical orientation and configuration (e.g., relative dimensions of the bumper rolls 510). In various embodiments, the support region 502 may comprise 4 bumper rolls 510 spaced at least substantially evenly around the perimeter of the spout 500 (e.g., at 90 degree intervals around the perimeter of the spout 500). In various embodiments, the bumper rolls 510 may each be at least substantially ovular and convex, extending away from the spout 500 and having a curved outer surface. Moreover, the bumper rolls 510 may be hollow, having a wall thickness (measured between the exterior surface and the interior surface of the bumper rolls 510) at least substantially similar to the wall thickness of the spout 500. In certain embodiments, the bumper rolls 510 may have a shape and configuration as is well-known in the art, and may be configured to enable existing mechanisms (e.g., robotic arms) to grasp the container 1 and maneuver the container 1, while the container 1 is suspended by the bumper rolls 510. Accordingly, the bumper rolls 510 may extend a distance away from the exterior surface of the spout such that mechanisms are enabled to grasp and support the container by the bumper rolls 510.

The support region 502 additionally comprises support protrusions 520 spaced around the perimeter of the spout 500. In various embodiments, the support protrusions 520 are aligned with a center line of a corner 110 of the container 1 and/or a short sidewall 130 of the container 1 (e.g., the short sidewall 130 may converge proximate the spout 500, and accordingly the support protrusions 520 may be adjacent the converged portion of the short sidewalls 130 that form a corner 110). In various embodiments, the support protrusions 520 are spaced at least substantially equally around the perimeter of the spout 500. In certain embodiments, the support protrusions 520 are arranged alternatingly with the bumper rolls 510. For example, an embodiment comprises 4 support protrusions 520 arranged at substantially 90 degree intervals around the perimeter of the spout 500, and arranged at a 45 degree offset from the 4 bumper rolls 510 (which may be spaced evenly at 90 degree intervals around the perimeter of the spout 500). Moreover, the support protrusions 520 may be spaced a distance away from the bumper rolls 510 to enable existing gripper mechanisms to engage the bumper rolls 510 to support the container 1 during movement.

Figure 3:
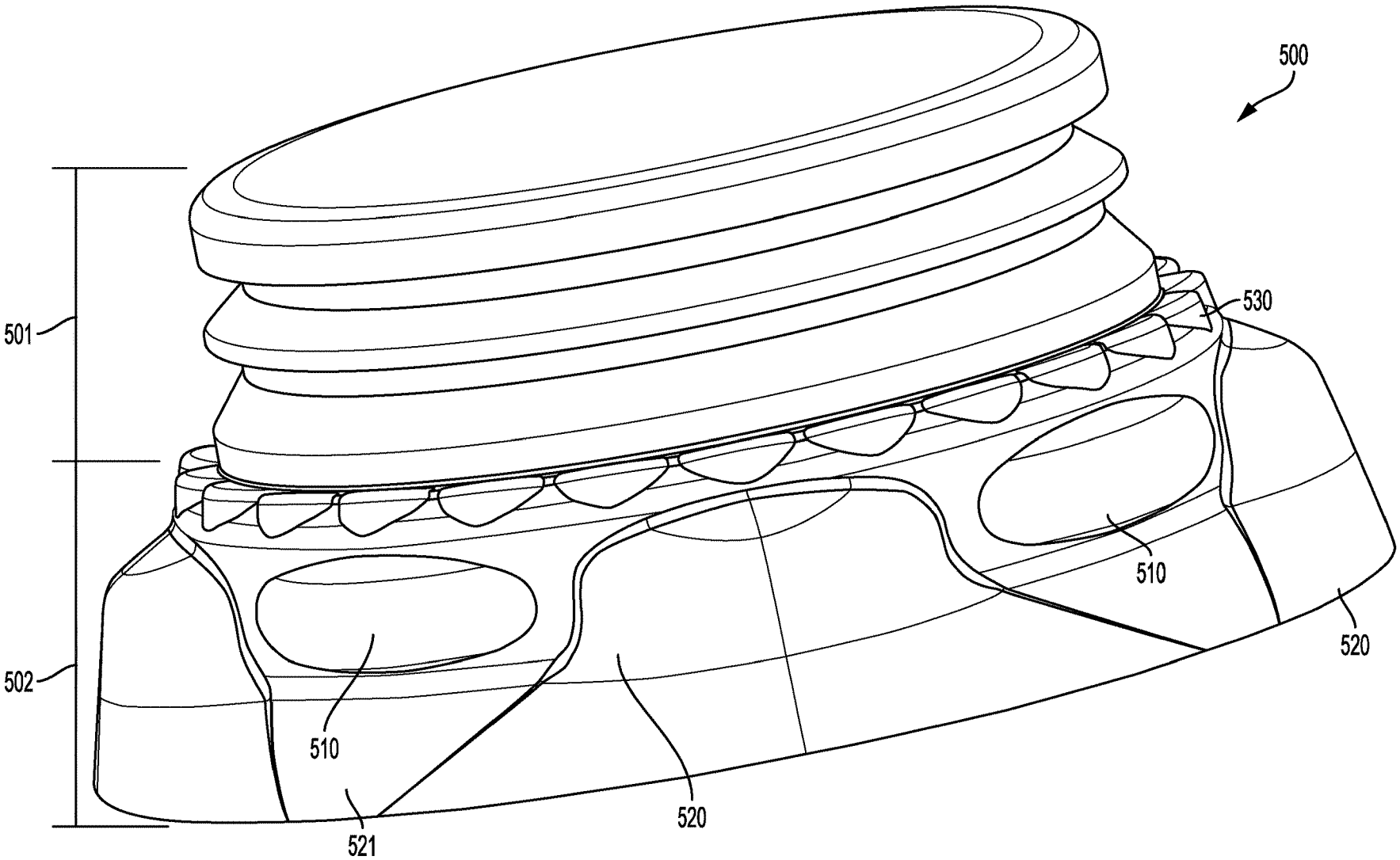
FIG. 3 shows a close-up isometric view of a spout according to another embodiment.
Figure 4:
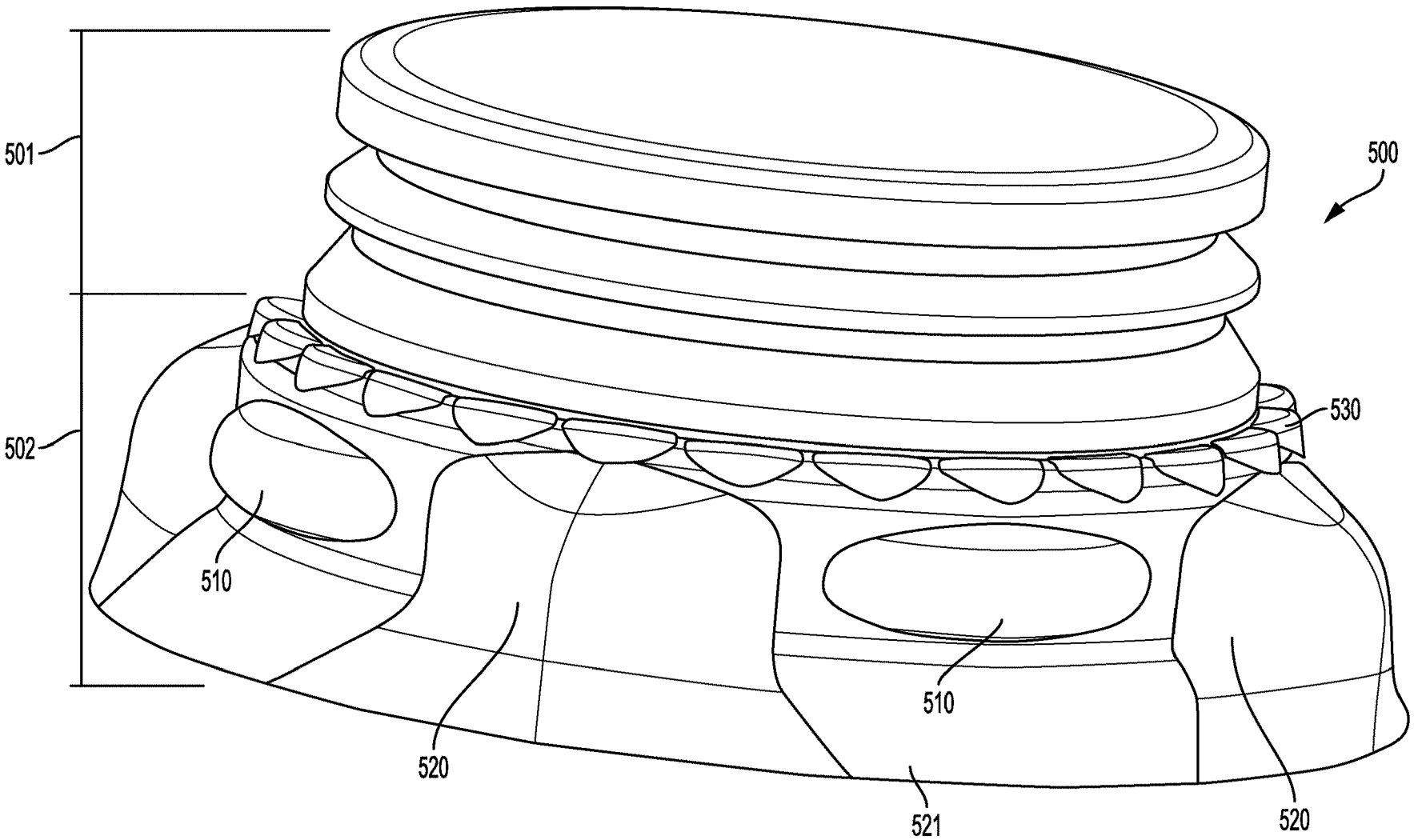
FIGS. 4-7 show a close-up isometric views of various spout configurations according to yet other embodiments.

In various embodiments, the support protrusions 520 comprise generally convex features extending radially away from the spout 500. In various embodiments, the support protrusions 520 extend away from the spout by a distance at least substantially equal to the bumper rolls 510. However, as shown in FIGS. 3-4, which illustrate alternative configurations of a spout 500, the support protrusions 520 may extend away from the spout by a distance greater than the bumper rolls 510 or less than the bumper rolls 510. In various embodiments, the support protrusions 520 may have a radius of curvature within the same elevation as the bumper rolls 510, and the radius of curvature of the support protrusions 520 extend about a center point of the curvature that does not align with the center point of the spout 500. Accordingly, the radius of curvature of the support protrusions 520 may be smaller than the radius of the spout 500.

Moreover, the support protrusions 520 may comprise a complex curvature, having an at least substantially continuous radius of curvature between a top point of the support protrusion 520 and the bottom point of the support protrusion 520. The vertical radius of curvature of the support protrusions 520 may be concave, having a center point outside of the container 1 itself. However, as shown in FIG. 3, the support protrusions 520 may not define a vertical curvature, such that the support protrusions define a generally cylindrical exterior surface. As yet another example, as shown in FIG. 4, the support protrusions may define a generally convex vertical radius of curvature.

Moreover, the top point of the support protrusion 520 may be aligned with a top edge of the support region 502, defining the transition between the support region and the cap region. As yet another example, as shown in FIG. 4, the top point of the support protrusions 520 may extend beyond a top edge of the support region 502, and may intersect the one or more ridges 530. Moreover, the bottom point of the support protrusion 520 may be aligned with a bottom edge of the support region 502, defining a transition between the support region 502 and the step 503. In various embodiments, the support protrusions 520 define a curved top portion that extends between side edges of the support protrusions 520 and the top point of the support protrusions 520.

The side edges of the support protrusions 520 may slope downward and toward adjacent bumper rolls 510. The sidewalls of adjacent support protrusions 520 (e.g., bounding an included bumper roll 510) may blend together below the bumper rolls 510 to form an at least substantially continuous support portion 521 extending around the perimeter of the support region 502, the support portion 521 having an at least substantially continuous concave radius. However, as shown in FIGS. 3-4, the continuity of the support portion 521 may be interrupted by the various support protrusions 520, which may extend radially beyond the support portion 521. The sidewalls may slope downward and toward the adjacent bumper rolls 510, while having a radius of curvature that corresponds to the radius of curvature of the side edges of the bumper roll 510, such that the side edges of the support protrusions 520 maintain an at least substantially continuous spacing away from the edges of adjacent bumper rolls 510. However, as shown in FIG. 4, the sidewalls may slope downward and toward the adjacent bumper rolls 510, but the sidewalls may not extend below the bumper rolls 510. The continuous support portion 521 below the bumper rolls 510 likewise maintains a minimum spacing away from the edges of the bumper rolls 510, the minimum spacing distance between the support portion 521 and the bumper rolls 510 being at least substantially equal to the spacing between the side edges of the support portions 520 and the bumper rolls 510.

The support protrusions 520 are configured to transfer axial crushing forces exerted onto the spout 500 in a direction aligned with a center line of the container 1 through the spout and into the supportive corners 110 of the container 1. Because the support region 502 of the spout 500 does not define a concentric, circular region aligned with the other regions of the spout 500 (due to the curvature of the support portions 520), the support protrusions 520 provide increased crushing resistance relative to containers that do not comprise similar support protrusions. The support protrusions 520 thereby impede crushing/collapse/partial collapse of the container 1 and/or the spout 500, which may otherwise form permanent and/or semi-permanent creases, bends, and/or the like that may have led to container failure.

Moreover, in certain embodiments, the spout 500 may be configured to provide additional rigidity to the container 1 while a cap is secured thereto. Accordingly, the container 1 may have a higher crush resistance strength while the cap is secured relative to the spout.

Figure 5:
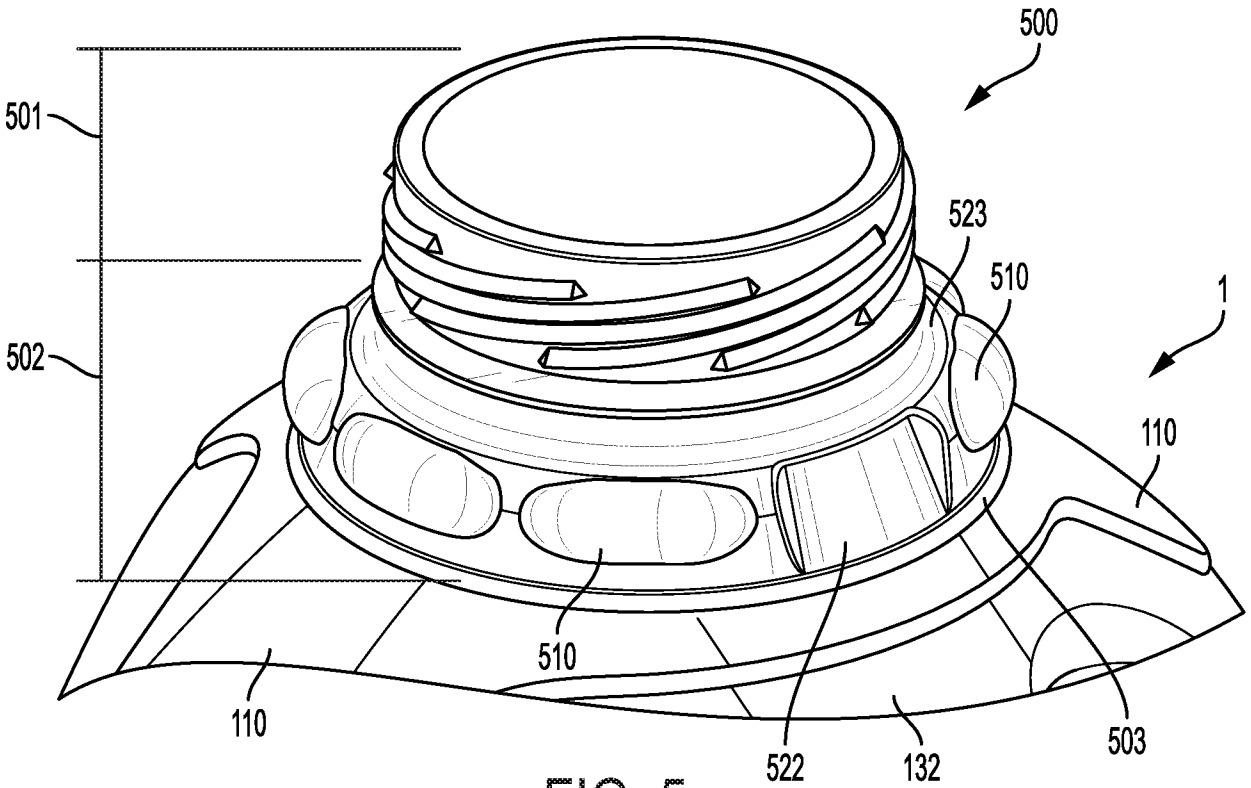
Figure 6:
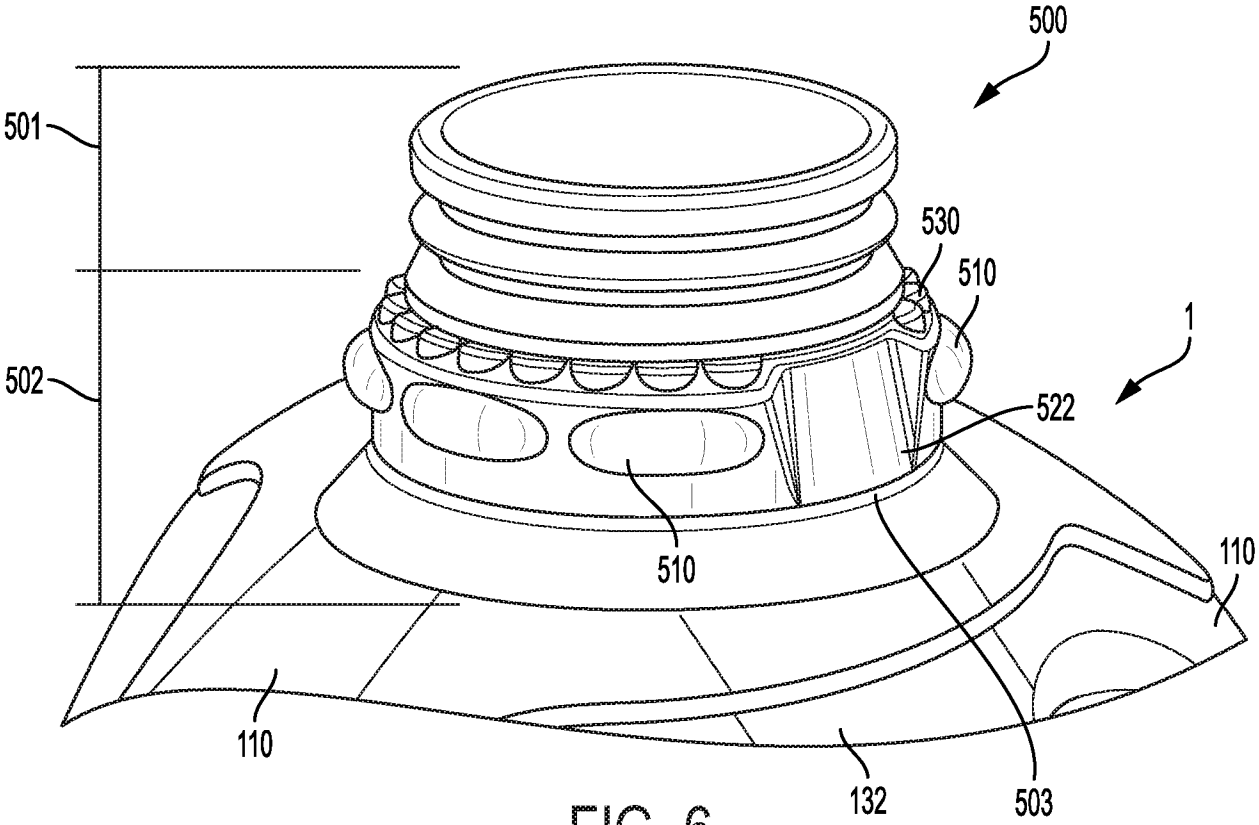
Figure 7:
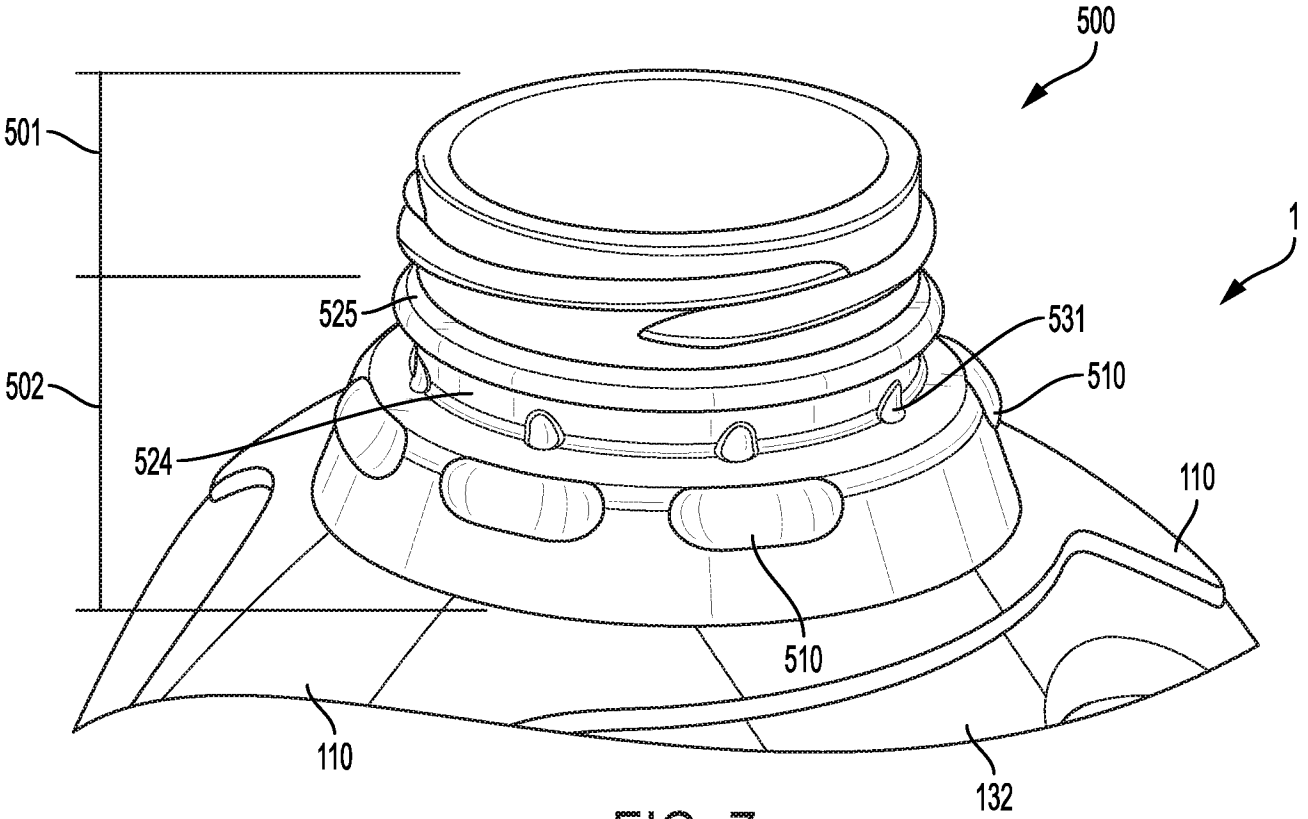

FIGS. 5-7 provide views of alternative spout configurations. In the embodiment shown in FIG. 5, the spout 500 extends above the top converging portion 132 and forms an opening from which the contents of the container 1 may be added to the container 1 and/or removed from the container 1. The spout 500 may define a raised step 503 surrounding the spout 500 and intersecting the top converging portion 132. The raised step 503 may extend between the top converging portion and a support region 502 extending at least partially vertically from the raised step 503. The support region 502 may define a plurality of protrusions 510 and one or more support indentions 522 thereon and spaced around the perimeter of the support region 502. In certain embodiments as shown in FIG. 5, the support region 502 may comprise a plurality of sloped portions, wherein a first slope portion extends from the raised step 503 to the second slope portion, and the second slope portion extends from the first slope portion to a concave support ring 523 surrounding the spout 500. The concave support ring 523 may have a radius of curvature outside of the diameter of the spout 500, which causes vertical crushing forces exerted on the spout 500 to be distributed around the perimeter of the spout 500, and ultimately into the vertical sidewalls of the container 1.

The concave support ring 523 may extend upward to a cap engagement portion 501 defining one or more threads, nipples, and/or the like to engage a removable cap (not shown) such that the removable cap may be selectably secured to the container 1.

In various embodiments, one or more portions of the spout 500 may have a wall thickness greater than the wall thickness of remaining portions of the container 1. Particularly in embodiments comprising a threaded cap engagement portion 501, the cap engagement portion 501 may not be symmetrical across a central plane of the container 1.

The support region 502 comprises a plurality of bumper rolls 510 spaced around the perimeter of the spout 500. These bumper rolls 510 may have a configuration similar to those described above in relation to FIGS. 2-4. In certain embodiments, the support region 502 may comprise a plurality of bumper rolls 510 (e.g., 6 bumper rolls 510) spaced around the perimeter of the spout 500. As shown in FIG. 5, the bumper rolls 510 may define a first grouping of bumper rolls 510 on a first side of the spout 500, and a second grouping of bumper rolls 510 on a second side of the spout 500. The first and second grouping of bumper rolls 510 may be separated by support indentions 522 on opposing sides of the spout 500. The support indentions 522 may have a width (measured around the perimeter of the support region 502) at least approximately equal to the width of the bumper rolls 510; and a height at least substantially equal to the height of the support region 502. The support indentions 522 may have a flat portion (e.g., planar) inset relative to portions of the support region 502; however in certain embodiments the support indentions 522 may have a convex portion having a radius of curvature aligned with a centerline of the spout 500. The support indentions 522 are inset relative to portions of the support region 502 via concave portions (e.g., having a radius of curvature outside of the spout 500) extending between the flat portion (or convex portion) and the edges of the support indentions 522 at the transition to the support region 502.

The support indentions 522 are configured to transfer axial crushing forces exerted onto the spout 500 in a direction aligned with a center line of the container 1 through the spout 500 and into the supportive corners 10 of the container. Accordingly, the support indentions 522 according to various embodiments may be aligned with corners of the container 1, a handle 400 of the container, and/or another high-strength portion of the container sidewalls. Because the support indentions 522 incorporate vertical wall portions (e.g., in part from the edges between the support region 502 and the support indentions 522, these support indentions 522 provide increased strength for the spout 500, thereby increasing the vertical crushing resistance of the container 1.

FIG. 6 illustrates yet another alternative spout configuration. Like the configuration shown in FIG. 5, the spout 500 shown in FIG. 6 comprises a plurality of bumper rolls 510 aligned with support indentions 522 (positioned on opposite sides of the spout 500) within a support portion 502 of the spout 500. However, the support portion 502 may be at least substantially vertical, and the bumper rolls 510 may be positioned proximate the upper edge of the support portion 502.

Moreover, the support indention 522 may extend at least partially into the cap region 501, which may comprise a series of ridges 530 as described in relation to FIGS. 2-4. The support indentions 522 may separate the ridges 530 into two groupings of ridges 530 on opposing sides of the spout 500.

Like the configuration shown in FIG. 5, the support indentions 522 shown in FIG. 6 serve to increase the vertical crush resistance of the spout 500 and the container 1 as a whole, by directing axial crushing forces exerted on the spout 500 toward the vertical sidewalls of the container 1, thereby avoiding potential pinch points that may be subject to crushing without such structural enhancements.

Finally, FIG. 7 illustrates yet another embodiment of a spout 500. As shown therein, the spout 500 extends above the top converging portion 132 and forms an opening from which the contents of the container 1 may be added to the container 1 and/or removed from the container 1. The spout 500 defines a support region 502 extending from the top converging portion 132. The support region may define a plurality of protrusions 510, 531, an indented ring 524, and/or the like to increase the axial crushing resistance of the spout 500. In certain embodiments as shown in FIG. 7, the support region 502 defines an angled surface extending around the perimeter of the spout 500, and extending from the top converging portion 132 to an inset ring 524. The indented ring may be defined as least in part by substantially planar top and/or bottom walls, and the transition between the angled surface and the inset ring 524 may be defined by a convex radius of curvature.

Like the embodiments shown in FIGS. 5-6, the spout configuration of FIG. 7 comprises a plurality of bumper rolls 510 positioned around the perimeter of the support region 502. The bumper rolls may have a configuration as described above, and the bumper rolls 510 may be aligned with a top edge of the angled portion, and may extend at least partially into the convex radius of curvature between the angled portion and the indented ring 524. Moreover, as shown in FIG. 7, the bumper rolls 510 may be separated into two pluralities of bumper rolls 510, separated by spaces positioned on opposite sides of the spout 500.

Moreover, the inset ring 524 may have a simple radius of curvature aligned with the centerline of the spout 500. As mentioned above, the inset ring 524 may be bounded by at least substantially planar portions at a top edge and a bottom edge of the inset ring 524, with concave transitions between the inset ring 524 and the planar portions. Specifically, the top planar portion may be a portion of a convex ring 525 on the spout, separating the inset ring 524 from the cap portion 501 of the spout 500. Moreover, the inset ring 524 may comprise a plurality of support protrusions 531 positioned along a bottom edge of the inset ring 524. These support protrusions 531 may be spaced at least substantially evenly around the perimeter of the spout 500. In certain embodiments, the support protrusions 531 may have a height at least substantially equal to half the height of the inset ring 524. At least some of the support protrusions 531 may be aligned with the bumper rolls 510 of the spout 500. These support protrusions 531 provide strength at an otherwise potential crush point within the spout 500. For example, the concave curvature between the inset ring 524 and the lower planar portion may be subject to stress concentrations resulting from an axial crushing force applied to the spout 500, and the support protrusions 531 thereby serve to increase the crush resistant strength of the spout 500 at this transition point. Accordingly, the support protrusions 531 transfer at least a portion of a received axial crushing load onto the lower portions of the support region 502, which ultimately transitions at least a portion of the axial load to the sidewalls of the container 1.

In various embodiments, the spout 500 may be located at least substantially centrally with respect to the profile of the container 1. As shown in FIG. 1, the spout 500 may be centrally located relative to the container 1, such that a centerline of the spout 500 is at least substantially aligned with a centerline of the container 1. Accordingly, the spout 500 may be spaced at least substantially equally from vertical portions of opposite pairs of sidewalls 130 of the container 1.

Method of Manufacture

Figure 8A:
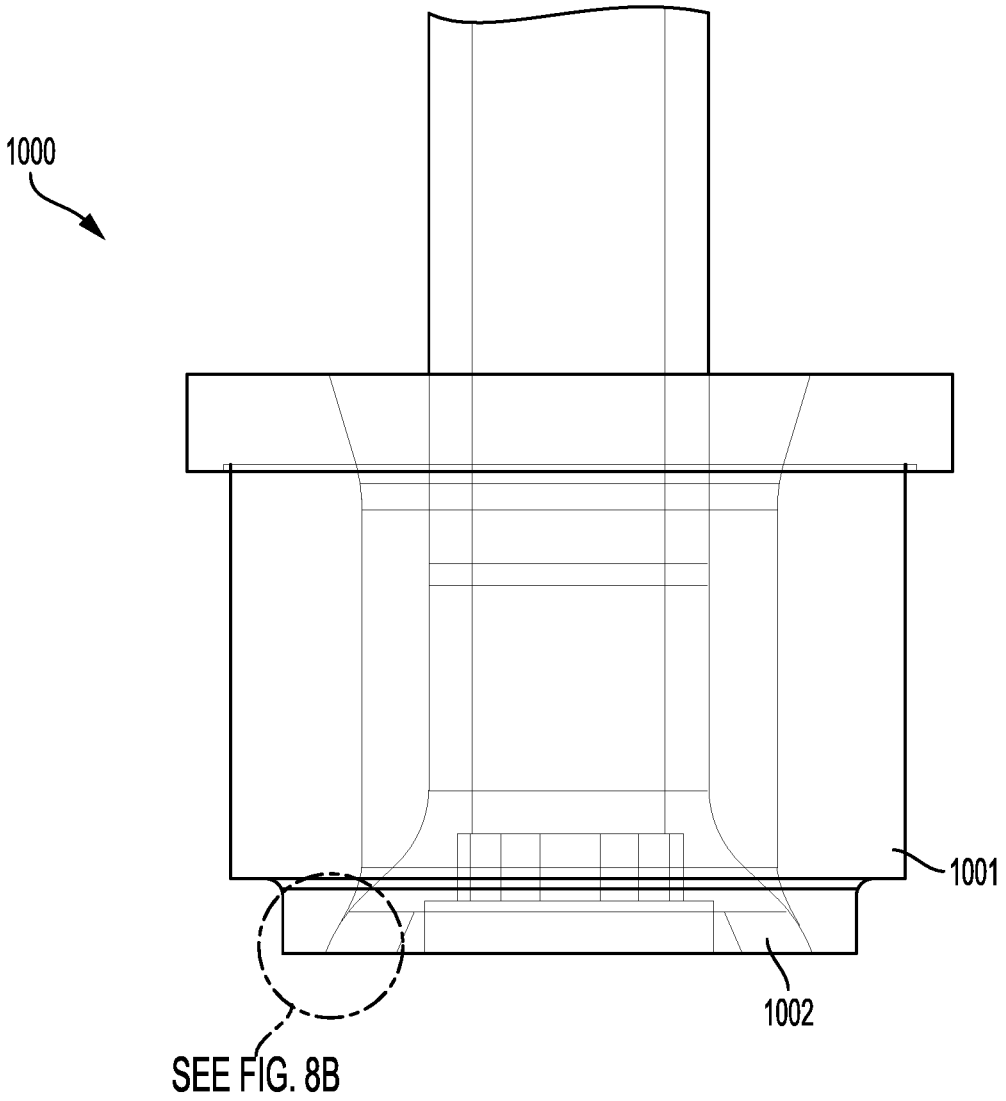
FIGS. 8A-8B show schematic diagrams of a head tool and die utilized to extrude material into a mold according to various embodiments.
Figure 8B:
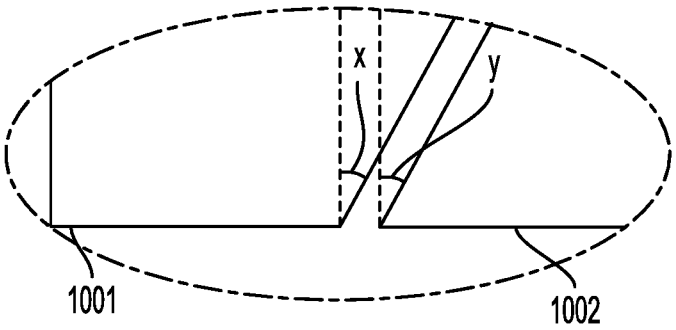

As mentioned, a container 1 according to various embodiments may be manufactured via extrusion blowmolding as described in co-pending U.S. patent application Ser. No. 15/255,403. Accordingly, a parison of molten plastic may be placed within a mold, secured relative to a head tool 1000 (as shown in FIGS. 8A-8B). As shown in the illustrated embodiments of FIGS. 8A-8B, the head tool 1000 may comprise a die 1001 and a mandrel 1002 positioned within the die 1001. In the illustrated embodiment of FIGS. 8A-8B, the die 1001 may comprise a hollow central aperture within which the mandrel 1002 may be positioned.

As shown in FIG. 8B, the mandrel 1002 is positioned within the die 1001 and spaced apart therefrom. The mandrel 1002 may be concentric with the die 1001, and may have a smaller outer diameter than the inner diameter of the die 1001. Accordingly, the mandrel 1002 may be spaced a distance from the die 1001. For example, the mandrel 1002 may be spaced at least about 0.005 inches from the die 1001. Moreover, as shown in FIG. 8B, the interior surface of the die 1001 may form an angle x with respect to vertical. Similarly, the exterior surface of the mandrel 1002 may form an angle y with respect to vertical. In various embodiments, x and y may be equal, however in certain embodiments, x and y are not equal. As a non-limiting example, x may be at least about 30 degrees and y may be at least about 32 degrees.

The parison may be placed within the mold by injecting the molten plastic material through the gap formed between the die 1001 and the mandrel 1002. Once sufficient material is positioned within the mold (e.g., 52-72 g for a one-gallon container 1), the parison may be inflated by injecting air through the center of the mandrel 1002, causing the parison to inflate and contour to the interior shape of the mold. The mold may have a shape corresponding to the shape of the container 1.

After inflating the parison to conform to the interior surface of the mold, the molten material may cool and harden to form the container 1. After the container has sufficiently hardened, the mold may be opened (e.g., by displacing two symmetrical mold halves away from one another (e.g., joining at a portion aligned at least substantially with a container symmetry plane)). The container 1 may be removed from the mold and/or head tool 1000.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A container comprising:

a hollow body portion;

a circular spout forming an opening in the hollow body portion, wherein the spout comprises:

a cap region configured to accept a container cap secured thereto;

an at least substantially circular lower spout boundary feature separating the circular spout from the hollow body portion; and a support region positioned between the cap region and the lower spout boundary feature, wherein the support region comprises:

a plurality of bumper rolls positioned around an exterior of the support region; and a plurality of support protrusions positioned between the cap region and the lower spout boundary feature and extending between a bottom edge of the cap region and a bottom edge of the support region around the exterior of the support region and aligned with the plurality of bumper rolls, wherein the plurality of support protrusions are positioned between adjacent bumper rolls such that the bumper rolls and the support protrusions are alternating around the perimeter of the spout, wherein each of the plurality of support protrusions defines a convex curvature having an at least partially horizontal radius of curvature smaller than a radius of the spout.

2. The container of claim 1, wherein:

the hollow body portion defines one or more vertical corners between adjacent sidewalls; and the plurality of support protrusions are aligned with a respective vertical corner of the hollow body portion.

3. The container of claim 1, wherein:

the hollow body portion defines alternating long sidewalls and short sidewalls, wherein adjacent sidewalls are separated by vertical corners; and the plurality of support protrusions are aligned with a respective short sidewall of the hollow body portion.

4. The container of claim 1, wherein adjacent support protrusions blend together to form a support portion below an included bumper roll; and wherein the adjacent support protrusions and the support portion are spaced a minimum distance away from the included bumper roll.

5. The container of claim 1, wherein:

the plurality of bumper rolls includes 4 bumper rolls spaced at 90 degree intervals around the perimeter of the spout; and the plurality of support protrusions includes 4 support protrusions spaced at 90 degree intervals around the perimeter of the spout, and wherein the plurality of support protrusions are offset by 45 degrees relative to the plurality of bumper rolls.

6. The container of claim 4, wherein the support portion extends at least substantially continuously around the perimeter of the spout.

7. The container of claim 1, wherein the spout further comprises:

a step positioned between the support region and the hollow body portion.

8. The container of claim 1, wherein the cap region is configured to accept a snap-on cap secured thereto.

9. The container of claim 1, wherein the cap region comprises a plurality of ridges adjacent a bottom edge of the cap region.

10. The container of claim 1, wherein each of the plurality of support protrusions defines a complex curvature having a concave curvature defining an at least partially vertical radius of curvature.

11. The container of claim 1, wherein each of the plurality of support protrusions defines a complex curvature having a convex curvature defining an at least partially vertical radius of curvature.

12. A circular container spout secured relative to a hollow container body comprising:

a cap region configured to accept a container cap secured thereto;

an at least substantially circular lower spout boundary feature separating the circular spout from the hollow body portion; and a support region positioned between the cap region and the lower spout boundary feature, wherein the support region comprises:

a plurality of bumper rolls positioned around an exterior of the support region; and a plurality of support protrusions positioned between the cap region and the lower spout boundary feature and extending between a bottom edge of the cap region and a bottom edge of the support region around the exterior of the support region and aligned with the plurality of bumper rolls, wherein the plurality of support protrusions are positioned between adjacent bumper rolls such that the bumper rolls and the support protrusions are alternating around the perimeter of the spout, wherein each of the plurality of support protrusions defines a convex curvature having an at least partially horizontal radius of curvature smaller than a radius of the container spout.

13. The container spout of claim 12, wherein adjacent support protrusions blend together to form a support portion below an included bumper roll; and wherein the adjacent support protrusions and the support portion are spaced a minimum distance away from the included bumper roll.

14. The container spout of claim 12, wherein:

the plurality of bumper rolls includes 4 bumper rolls spaced at 90 degree intervals around the perimeter of the spout; and the plurality of support protrusions includes 4 support protrusions spaced at 90 degree intervals around the perimeter of the spout, and wherein the plurality of support protrusions are offset by 45 degrees relative to the plurality of bumper rolls.

15. The container spout of claim 13, wherein the support portion extends at least substantially continuously around the perimeter of the spout.

16. The container spout of claim 12, wherein the spout further comprises:

a step positioned between the support region and the hollow body portion.

17. The container spout of claim 12, wherein the cap region is configured to accept a snap-on cap secured thereto.

18. The container spout of claim 12, wherein the cap region is configured to accept a screw-on cap secured thereto.

19. The container spout of claim 12, wherein the cap region comprises a plurality of ridges adjacent a bottom edge of the cap region.

20. The container spout of claim 12, wherein each of the plurality of support protrusions defines a complex curvature having a concave curvature defining an at least partially vertical radius of curvature.

21. The container spout of claim 12, wherein each of the plurality of support protrusions defines a complex curvature having a convex curvature defining an at least partially vertical radius of curvature.

22. A circular container spout secured relative to a hollow container body comprising:

a cap region configured to accept a container cap secured thereto;

an at least substantially circular lower spout boundary feature separating the circular spout from the hollow body portion; and a support region positioned between the cap region and the lower spout boundary feature, wherein the support region comprises:

a plurality of bumper rolls positioned around an exterior of the support region; and a plurality of support indentions positioned between the cap region and the lower spout boundary feature and extending between a bottom edge of the cap region and a bottom edge of the support region around the exterior of the support region and aligned with the plurality of bumper rolls, wherein the plurality of support indentions are positioned between adjacent bumper rolls such that the bumper rolls and the support indentions are alternating around the perimeter of the spout, wherein each of the plurality of support protrusions defines at least one concave curvature having an at least partially horizontal radius of curvature smaller than a radius of the container spout.

23. A circular container spout secured relative to a hollow container body comprising:

a cap region configured to accept a container cap secured thereto;

an at least substantially circular lower spout boundary feature separating the circular spout from the hollow body portion; and a support region positioned between the cap region and the lower spout boundary feature, wherein the support region comprises:

a plurality of bumper rolls positioned around an exterior of the support region; and an indent ring positioned between the plurality of bumper rolls and the cap region, wherein the indent ring comprises a plurality of support protrusions spaced around the perimeter of the spout, wherein the plurality of support protrusions are positioned between adjacent bumper rolls such that the bumper rolls and the support protrusions are alternating around the perimeter of the spout.

* * * * *